US007783209B2

(12) United States Patent
Uno et al.

(10) Patent No.: US 7,783,209 B2
(45) Date of Patent: Aug. 24, 2010

(54) IMAGE FORMING APPARATUS AND METHOD OF ACTIVATING THE APPARATUS DURING FILLING WITH DEVELOPING AGENT

(75) Inventors: Mugijirou Uno, Isehara (JP); Sadayuki Iwai, Yokohama (JP); Yuki Oshikawa, Yamato (JP)

(73) Assignee: Ricoh Company, Ltd., Tokyo (JP)

( * ) Notice: Subject to any disclaimer, the term of this patent is extended or adjusted under 35 U.S.C. 154(b) by 102 days.

(21) Appl. No.: 12/138,802

(22) Filed: Jun. 13, 2008

(65) Prior Publication Data

US 2008/0310865 A1 Dec. 18, 2008

(30) Foreign Application Priority Data

Jun. 18, 2007 (JP) ..... 2007-159823

(51) Int. Cl.
*G03G 15/00* (2006.01)
*G03G 15/08* (2006.01)

(52) U.S. Cl. ..... 399/27; 399/43; 399/75; 399/167; 399/258

(58) Field of Classification Search ..... 399/27, 399/43, 53, 75, 119, 120, 167, 258
See application file for complete search history.

(56) References Cited

U.S. PATENT DOCUMENTS

| | | | | |
|---|---|---|---|---|
| 5,548,377 | A | 8/1996 | Kato | 399/9 |
| 5,978,643 | A | 11/1999 | Uno | |
| 6,022,660 | A | 2/2000 | Uno | |
| 6,512,901 | B2 | 1/2003 | Uno | |
| 6,567,625 | B1 * | 5/2003 | Tatematsu et al. | 399/75 |
| 6,611,672 | B2 | 8/2003 | Aoki et al. | |
| 6,757,512 | B2 | 6/2004 | Miyawaki et al. | |
| 6,792,222 | B2 | 9/2004 | Iwai | |
| 6,889,030 | B2 | 5/2005 | Koide et al. | |
| 6,912,370 | B2 | 6/2005 | Iwai | |
| 6,947,682 | B2 | 9/2005 | Kosugi et al. | |

(Continued)

FOREIGN PATENT DOCUMENTS

EP 1 918 785 A2 5/2008

(Continued)

OTHER PUBLICATIONS

U.S. Appl. No. 09/429,305, filed Oct. 28, 1999, Mugijiroh Uno.

*Primary Examiner*—Sophia S Chen
(74) *Attorney, Agent, or Firm*—Oblon, Spivak, McClelland, Maier & Neustadt, L.L.P.

(57) ABSTRACT

An image forming apparatus includes an image carrying member, a development unit, a first driving unit, a second driving unit, and a cleaning blade. The image carrying member forms a latent image thereon. The development unit develops the latent image formed on the image carrying member. The first driving unit drives the image carrying member. The second driving unit drives the development unit. The cleaning blade, contactable against the image carrying member, removes materials including toner remaining on the image carrying member. When an agent-empty development unit is filled with a developing agent, the second driving unit is activated to start a driving of the development unit, and the first driving unit is activated to start a driving of the image carrying member after starting a developing agent filling operation to the development unit.

18 Claims, 5 Drawing Sheets

U.S. PATENT DOCUMENTS

| | | | | |
|---|---|---|---|---|
| 7,095,972 | B2 | 8/2006 | Iwai | |
| 7,110,696 | B2 | 9/2006 | Murakami et al. | |
| 7,155,152 | B2 | 12/2006 | Iwai et al. | |
| 7,272,354 | B2 | 9/2007 | Murakami et al. | |
| 7,280,773 | B2 | 10/2007 | Uno | |
| 7,343,126 | B2 | 3/2008 | Miyawaki et al. | |
| 2002/0098013 | A1* | 7/2002 | Kamimura | 399/167 |
| 2003/0202806 | A1* | 10/2003 | Katoh et al. | 399/27 |
| 2006/0008281 | A1* | 1/2006 | Matsumoto et al. | 399/27 |
| 2006/0029783 | A1 | 2/2006 | Iwai | |
| 2007/0003315 | A1 | 1/2007 | Iwai | |
| 2007/0116494 | A1 | 5/2007 | Uno et al. | |
| 2007/0280742 | A1 | 12/2007 | Matsumoto et al. | |
| 2008/0063434 | A1 | 3/2008 | Uno et al. | |
| 2008/0124136 | A1 | 5/2008 | Oshikawa | |
| 2009/0103935 | A1 | 4/2009 | Uno et al. | |
| 2009/0116872 | A1 | 5/2009 | Sugimoto et al. | |

FOREIGN PATENT DOCUMENTS

| | | | |
|---|---|---|---|
| JP | 01-076084 | A * | 3/1989 |
| JP | 6-19324 | | 1/1994 |
| JP | 3545779 | B2 | 4/2004 |
| JP | 2006-84892 | | 3/2006 |

* cited by examiner

IMAGE FORMING APPARATUS AND METHOD OF ACTIVATING THE APPARATUS DURING FILLING WITH DEVELOPING AGENT

CROSS-REFERENCE TO RELATED APPLICATIONS

This application claims priority from Japanese Patent Application No. 2007-159823, filed on Jun. 18, 2007 in the Japan Patent Office, the entire contents of which are hereby incorporated by reference herein.

BACKGROUND OF THE INVENTION

1. Field of the Invention

The present disclosure generally relates to an image forming apparatus using electrophotography, and more particularly, to an image forming apparatus having a development unit, which is automatically refilled with new or fresh developing agent at a given timing, such as at installation, maintenance, or the like.

2. Description of the Background Art

Typically, an image forming apparatus, such as a copier or a printer, includes a development unit, which is filled or refilled with a two-component developing agent composed substantially of toner and carrier at a given timing, such as at product delivery timing (or installation) of the image forming apparatus and replacement of the developing agent (or maintenance), for example.

Specifically, when an image forming apparatus is installed at a user location (i.e., product delivery timing), the development unit is filled with two-component developing agent before initializing settings and checking operation of the image forming apparatus because the development unit is not filled with the developing agent when shipped from a factory (i.e., the development unit is in an agent-empty condition). Further, when the developing agent is spent, the now-used developing agent is removed from the development unit and the development unit is refilled with new (or fresh) developing agent into (i.e., replacement timing of developing agent).

One type of conventional image forming apparatus includes a handle, which is manually operable, to facilitate refilling a development unit with developing agent, in which the handle is manually rotated to fill the development unit with the developing agent.

Further, another known image forming apparatus includes a development unit storing a developing agent, in which the development unit includes a shutter that is opened when starting a developing process by the development unit and an image carrying member, in which the shutter is disposed at an opening portion of the development unit facing the image carrying member.

However, such conventional image forming apparatuses may have some drawbacks for filling the developing agent to the development unit. For example, such conventional image forming apparatuses may not have simpler configuration and operation for filling the developing agent, and curling of a cleaning blade may occur when filling the developing agent.

Specifically, a manually operated handle may pose an inconvenience for a user. In particular, if the image forming apparatus is large, more developing agent is supplied to the development unit, requiring greater force to operate the handle, which is also inconvenient for the user.

Moreover, if the development unit has the shutter at the opening portion, as mentioned above, the developing agent stored in the development unit (i.e., the developing agent is carried on the developing agent carrier) can be used to prevent scratches or blemishes on a surface of the image carrying member. However, a manual operation is required to fill the development unit with developing agent when replacing the developing agent, which is inconvenient for the user. Further, the development unit may have a complex configuration due to an installation of such shutter, and restrict relative positions of an image carrying member and a developing agent carrier.

Conceivably, a developing agent may be automatically filled into a development unit by activating and driving an image carrying member and a development unit of an image forming apparatus at a given timing, such as at installation timing or maintenance, wherein the image carrying member and the development unit can be activated and driven by a drive unit. However, during such agent filling operation, the developing agent may not be evenly and sufficiently supplied across the development unit, by which an image carrying member may be operated for a long period of time without toner supply on the image carrying member. Accordingly, toner cannot be sufficiently supplied to a leading edge of a cleaning blade, which contacts the image carrying member, by which a curling of the cleaning blade may occur. If such blade curling occurs, the image carrying member cannot be cleaned effectively, and another drawback, such as abnormal noise generation, may occur.

In light of the aforementioned drawbacks, there is a need for an image forming apparatus that can effectively fill or refill a development unit with a developing agent using a relatively simpler configuration and operation.

SUMMARY

In an aspect of the present disclosure, an image forming apparatus includes an image carrying member, a development unit, a first driving unit, a second driving unit, and a cleaning blade. The image carrying member forms a latent image thereon. The development unit develops the latent image formed on the image carrying member. The first driving unit drives the image carrying member. The second driving unit drives the development unit. The cleaning blade, contactable against the image carrying member, removes materials including toner remaining on the image carrying member. When the development unit is filled with a developing agent having an agent-empty condition, the second driving unit is activated to start a driving of the development unit, and the first driving unit is activated to start a driving of the image carrying member after starting a developing agent filling operation to the development unit.

In another aspect of the present disclosure, a method of filling a developing agent to a development unit, having an agent-empty condition, for use in image forming apparatus having an image carrying member includes 1) activating the development unit to fill a developing agent to the development unit, and 2) activating the image carrying member to rotate the image carrying member after activating the developing unit for a given time.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
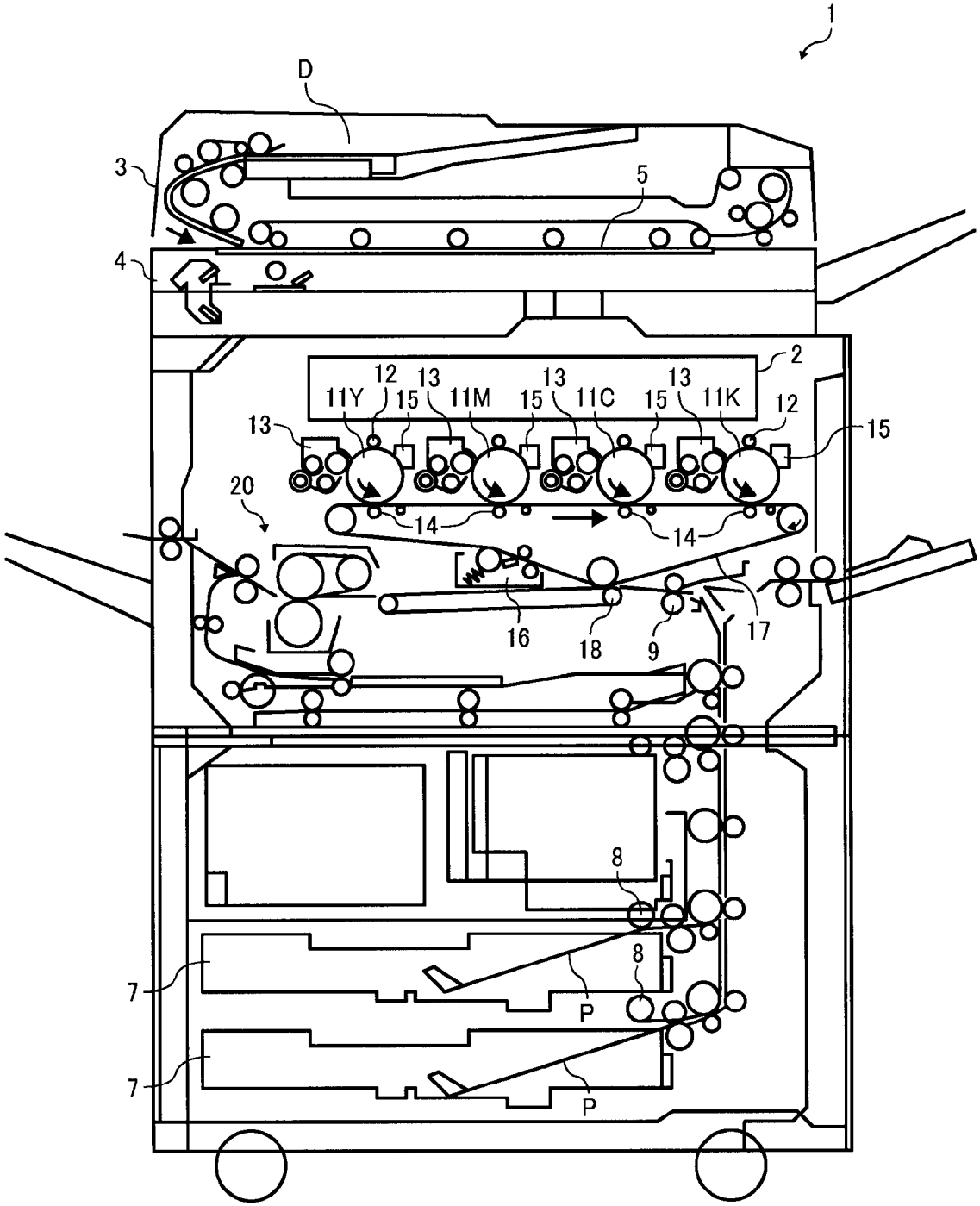
FIG. 1 illustrates a schematic configuration of an image forming apparatus according to an exemplary embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus according to an exemplary embodiment is described with reference to accompanying drawings. The image forming apparatus may employ electrophotography and tandem arrangement, for example, but not limited thereto.

In this disclosure, "agent-empty condition" or "agent-not-stored condition" of a development unit means that a developing agent does not completely exist in the development unit or a tiny amount of developing agent remains in the development unit. For example, when used developing agent is removed from the development unit for replacing the developing agent with new or fresh one, a tiny amount of developing agent may remain in the development unit (i.e., developing agent is not completely removed), but such development unit can be defined as "agent-empty condition" or "agent-not-stored condition."

Hereinafter, a configuration and operation of an image forming apparatus according to an exemplary embodiment is described with reference to FIG. 1. As illustrated in FIG. 1, an image forming apparatus 1 includes an optical writing unit 2, a document feeder 3, a scanning unit 4, a sheet feed unit 7, a registration roller 9, photoconductor drums 11Y, 11M, 11C, and 11K, a charging device 12, a development unit 13, a primary transfer roller 14, a cleaning unit 15, a belt cleaning unit 16, an intermediate transfer belt 17, a secondary transfer roller 18, and a fixing unit 20, for example.

The optical writing unit 2 emits a laser beam corresponding to the input image information. The document feeder 3 transports a document D to the scanning unit 4. The scanning unit 4 scans image information of the document D. The sheet feed unit 7 stores a recording medium P, such as transfer sheet. The registration roller 9 adjusts a transport timing of the recording medium P. The photoconductor drums 11Y, 11M, 11C, and 11K, used as an image carrying member, form toner images of each color of yellow, magenta, cyan, and black. The charging device 12 charges the photoconductor drums 11Y, 11M, 11C, and 11K. The development unit 13 develops electrostatic latent images formed on the photoconductor drums 11Y, 11M, 11C, and 11K as toner images. The primary transfer roller 14 superimposingly transfers the toner images from the photoconductor drums 11Y, 11M, 11C, and 11K to the intermediate transfer belt 17. The cleaning unit 15 recovers toner remaining on the photoconductor drums 11Y, 11M, 11C, and 11K.

The belt cleaning unit 16 cleans the intermediate transfer belt 17. The intermediate transfer belt 17 is superimposingly transferred with a plurality of color toner images from the photoconductor drums 11Y, 11M, 11C, and 11K. The secondary transfer roller 18 transfers the color toner images from the intermediate transfer belt 17 to the recording medium P. The fixing unit 20 fixes the color toner images on the recording medium P. Although not shown, containers for each color of toner (i.e., yellow, cyan, magenta, black) and a container for carrier (or magnetic carrier) are disposed over the photoconductor drums 11Y, 11C, 11M, and 11K. Toner and carrier are refilled from the containers to the development unit 13.

Figure 2:
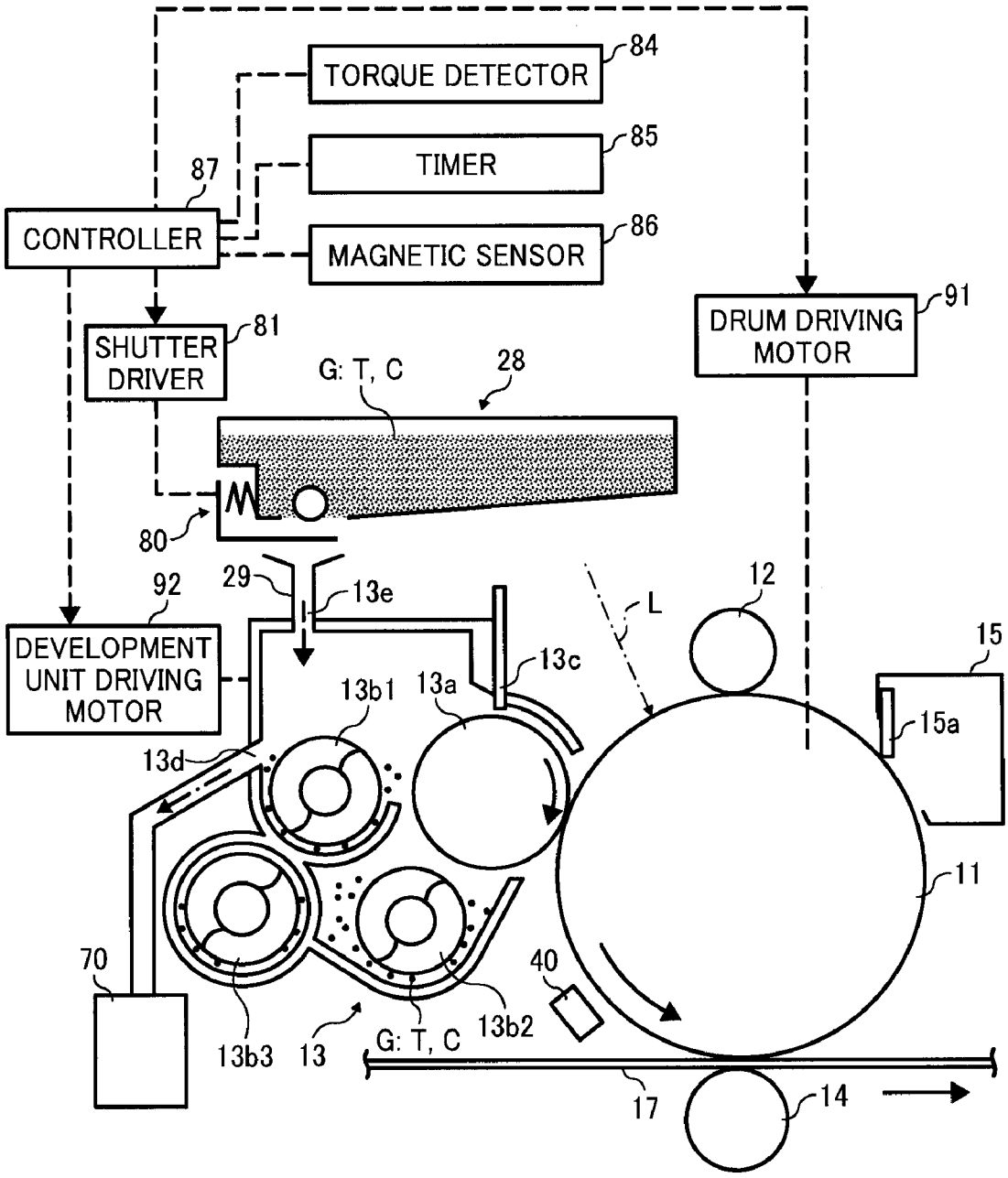
FIG. 2 illustrates a schematic configuration of an image forming engine according to an exemplary embodiment.

A description is now given to an image forming operation of the image forming apparatus 1 with reference to FIGS. 1 and 2. The document D placed on a document tray is transported in a direction of an arrow in FIG. 1 using a transport roller of the document feeder 3, and placed on a contact glass 5 of the scanning unit 4, at which image information of the document D is optically scanned.

Specifically, the scanning unit 4 uses a light lamp to scan the image information of the document D by irradiating a light beam to the image information of the document D. A reflection light from the document D is focused on a color image sensor via mirrors and a lens. The color image sensor converts color image information of the document D into electrical image signal of RGB (red, green, blue). Based on the RGB image signals, an image processing unit conducts color conversion process, color correction process, spatial frequency correction process or the like to generate color image data for yellow, magenta, cyan, and black.

Such color image data for yellow, magenta, cyan, and black are transmitted to the optical writing unit 2. The optical writing unit 2 emits a laser beam L (refer to FIG. 2), corresponding to each of color image data, to the photoconductor drums 11Y, 11M, 11C, and 11K.

The photoconductor drums 11Y, 11M, 11C, and 11K rotates in a clockwise direction in FIG. 1. A drum driving motor 91 used as a first driving unit, shown in FIG. 2, drives or rotates the photoconductor drum 11 and the charging device 12 (e.g., charge roller). Further, a development unit driving motor 92 used as a second driving unit, shown in FIG. 2, drives or rotates the development unit 13. The drum driving motor 91 (first driving unit) and the development unit driving motor 92 (second driving unit) are independently disposed, for example.

The photoconductor drums 11Y, 1M, 11C, and 11K are uniformly charged by the charging device 12 to set a given potential on the photoconductor drums 11Y, 11M, 11C, and 11K (charging process). When the charged photoconductor drums 11Y, 11M, 11C, and 11K come to a position of a laser beam irradiation, the optical writing unit 2 emits laser beams corresponding to image signals of each color, in which the laser beams pass through different optical paths for each of yellow, magenta, cyan, and black color (exposure process).

A laser beam corresponding yellow data is irradiated on a surface of the photoconductor drum 11Y. The laser beam corresponding yellow data scans the photoconductor drum 11Y in a main scanning direction to form an electrostatic latent image corresponding to yellow data on the photoconductor drum 11Y, in which the laser beam is deflected by a polygon mirror rotating at high speed.

Similarly, a laser beam corresponding magenta data is irradiated on a surface of the photoconductor drum 11M to form an electrostatic latent image corresponding to magenta data on the photoconductor drum 11M. Similarly, a laser beam corresponding cyan data is irradiated on a surface of the photoconductor drum 11C to form an electrostatic latent image corresponding to cyan data on the photoconductor drum 11C. Similarly, a laser beam corresponding black data is irradiated on a surface of the photoconductor drum 11K to form an electrostatic latent image corresponding to black data on the photoconductor drum 11K.

Then, the photoconductor drums 11Y, 11M, 11C, and 11K come to a position facing the development unit 13, at which the development unit 13 develops the electrostatic latent images on the photoconductor drums 11Y, 11M, 11C, and 11K by supplying toner of each color (developing process). After such developing process, the photoconductor drums 11Y, 11M, 11C, and 11K come to a position facing the intermediate transfer belt 17. As shown in FIG. 1, the transfer roller 14, disposed at an inner face side of the intermediate transfer belt 17, counter-faces the photoconductor drums 11Y, 11M, 11C, and 11K via the intermediate transfer belt 17. At the position of the transfer roller 14, the color toner image formed on the photoconductor drums 11Y, 11M, 11C, and 11K are sequentially and superimposingly transferred to the intermediate transfer belt 17 (primary transfer process).

After such primary transfer process, the photoconductor drums 11Y, 11M, 11C, and 11K come to a position facing the cleaning unit 15, at which the cleaning unit 15 recovers toner remaining on the photoconductor drums 11Y, 11M, 11C, and 11K (cleaning process). Specifically, as shown in FIG. 2, the cleaning unit 15 includes a cleaning blade 15*a*, which contacts the photoconductor drum 11 to scrape and recover toner remaining on the photoconductor drum 11. After such cleaning process, the photoconductor drums 11Y, 11M, 11C, and 11K are de-charged by a de-charge lamp (not shown) to complete one cycle of image forming process for the photoconductor drums 11Y, 11M, 11C, and 11K.

Meanwhile, the intermediate transfer belt 17 having the superimposed color toner images travels in a clockwise direction in FIG. 1, and comes to a position facing the secondary transfer roller 18, at which the color toner images are transferred from the intermediate transfer belt 17 to the recording medium P (secondary transfer process). After such secondary transfer process, the intermediate transfer belt 17 comes to a position facing the belt cleaning unit 16, at which the belt cleaning unit 16 recovers toner remaining on the intermediate transfer belt 17 to complete one cycle of image transfer process for the intermediate transfer belt 17.

The recording medium P is transported to a secondary transfer nip from the sheet feed unit 7 via the registration roller 9, wherein the secondary transfer nip is set between the intermediate transfer belt 17 and the secondary transfer roller 18. Specifically, the recording medium P stored in the sheet feed unit 7 is fed by a feed roller 8 to a transportation guide, and then guided to the registration roller 9, from which the recording medium P is transported to the secondary transfer nip at a given timing.

The recording medium P having the color toner images is transported to the fixing unit 20 by a transport belt. The fixing unit 20 has a fixing belt and a pressure roller to fix the color toner images on the recording medium P (fixing process). After the fixing process, the recording medium P is ejected from the image forming apparatus 1 by an ejection roller to complete one cycle of image forming process.

Figure 3:
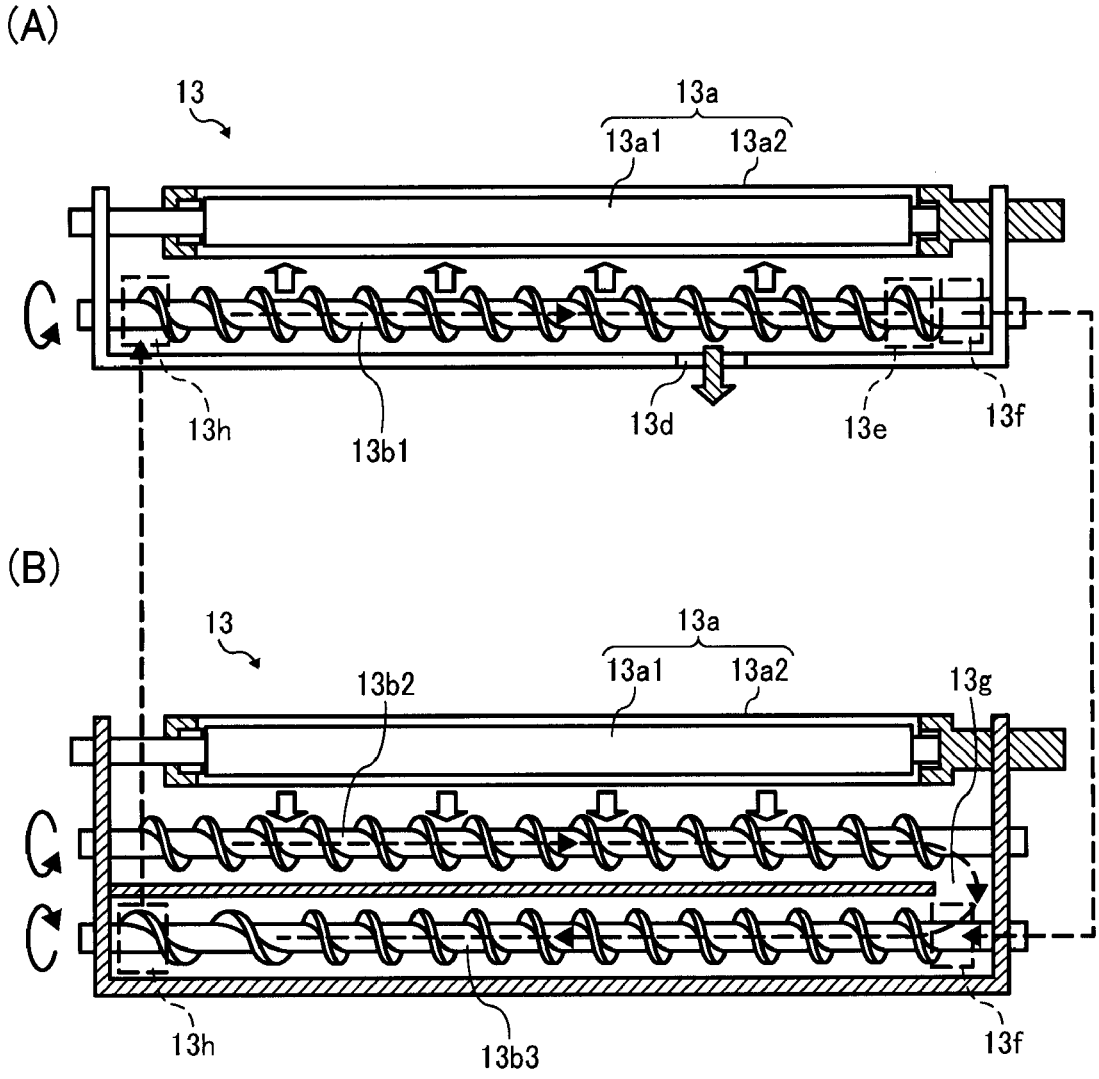
FIG. 3(A) illustrates a cross-sectional view of an upper part of the development unit, viewed from the above.
FIG. 3(B) illustrates a cross-sectional view of a lower part of the development unit, viewed from the above.
Figure 4:
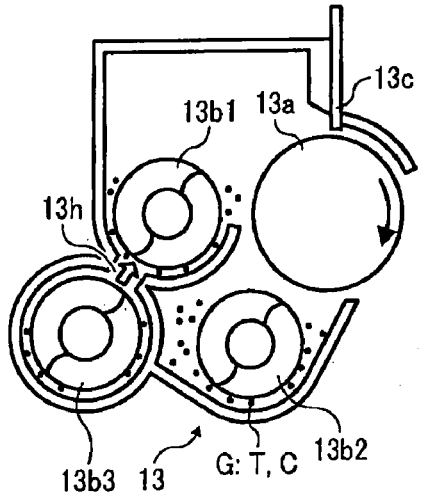
FIG. 4 illustrates a cross-sectional view of the development unit.

A description is now given to an image forming engine of the image forming apparatus 1 with reference to FIGS. 2 to 4. FIG. 2 illustrates a configuration for an image forming engine and the developing agent container 28. FIG. 3(A) illustrates a schematic cross-sectional view of an upper part of the development unit 13, which includes a first transport screw 13*b*1. FIG. 3(B) illustrates a schematic cross-sectional view of a lower part of the development unit 13, which includes a second transport screw 13*b*2 and a third transport screw 13*b*3. FIG. 4 illustrates a cross-sectional view of the development unit 13, which is cut at a position of a third interconnection 13*h*. Because the image forming engines have a similar configuration to one another and the developing agent containers have a similar configuration to one another, the image forming engine and developing agent container are illustrated by omitting suffix letters of YMCK in FIGS. 2 to 4.

As illustrated in FIG. 2, the image forming engine includes the photoconductor drum 11, the charging device 12, the development unit 13, and the cleaning unit 15, for example. The photoconductor drum 11 is an organic photoconductor, which can be charged to a negative polarity and is rotatable in a clockwise direction by a drive mechanism.

The charging device 12 may be a charge roller, having a metal core and a surface layer formed on the metal core. The surface layer may be a resin layer made of urethane resin having carbon black as conductive powder, a sulfurizing agent, and a foaming agent, for example. Such surface layer may be foamed as urethane layer having a middle range resistance and elastic behavior while shaped in a roller shape. The surface layer of the charging device 12 may be made of rubber material, such as urethane resin, ethylene/propylene/dien copolymer rubber (EPDM), butadiene-acrylonitrile rubber (NBR), silicone rubber, and isoprene rubber, and conductive material, such as carbon black and metal oxide, dispersed in the rubber material as resistance adjusting agent, or the surface layer may be made of foamed rubber of these.

The cleaning unit 15 includes the cleaning blade 15*a* contactable to the photoconductor drum 11 to remove and recover toner remaining on the photoconductor drum 11. The cleaning blade 15*a* may be made of rubber material, such as urethane resin, EPDM, NBR, silicone rubber, isoprene rubber, or the like. In an exemplary embodiment, the cleaning blade 15*a* contacts the photoconductor drum 11 in a counter direction. However, the cleaning blade 15*a* can be contacted to the photoconductor drum 11 in a trailing direction.

The development unit 13 has a developing roller 13*a*, used as a developing agent carrier, which is positioned proximity to the photoconductor drum 11. The developing roller 13*a* and the photoconductor drum 11 form a development area therebetween, in which magnetic brushes contact the photoconductor drum 11. The development unit 13 stores a developing agent G (two-component developing agent) substantially composed of toner T and carrier C. The development unit 13 develops an electrostatic latent image as a toner image on the photoconductor drum 11. The configuration and operation of the development unit 13 will be described later.

In an exemplary embodiment, the development unit 13 may employ a pre-mix development method. As for the pre-mix development method, new or fresh developing agent G is supplied to the development unit 13 from the developing agent container 28 while ejecting degraded developing agent G to an agent recovery vessel 70 from the development unit 13.

The developing agent container 28 (refer to FIG. 2) stores the developing agent G (toner T and carrier C), to be used for refilling the developing agent when the developing agent G in the development unit 13 is consumed by the developing process. The developing agent container 28 functions as toner cartridge for refilling new or fresh toner T to the development unit 13 and a cartridge for refilling new or fresh carrier C to the development unit 13. Specifically, the developing agent G is refilled to the development unit 13 at a given timing, which may be determined based on toner concentration information (toner ratio in developing agent G) or image concentration information formed on the photoconductor drum 11. In this discourse, terms of fill, refill, filling, or refilling may be used interchangeably.

The development unit 13 includes a magnetic sensor 86 as a toner concentration sensor, which is disposed in a transport route including the third transport screw 13*b*3 to detect toner concentration in the developing agent G, by which toner concentration information is obtained at a given timing. Further, the development unit 13 includes an optical sensor 40 to detect image concentration of a patch pattern formed on the photoconductor drum 11 at a given timing, by which image concentration information is obtained at given timing.

When such toner concentration information or image concentration information indicates a condition that toner amount in the development unit 13 is not sufficient, a shutter driver 81 opens (and closes) a shutter device 80 to refill new developing agent G to the development unit 13 from the developing agent container 28 via a refilling route. In an exemplary embodiment, a mixing ratio of toner T (toner concentration) with respect to carrier C in the developing agent container 28 is set relatively higher, for example.

Such refilling route may be a supply tube 29, which reliably guides the developing agent G (toner T and carrier C) from the developing agent container 28 to the development unit 13. Accordingly, the developing agent G discharged from the developing agent container 28 is refilled to the development unit 13 via the supply tube 29 and a refill port 13*e*.

A description is now given to the development unit 13 of the image forming apparatus 1. As shown in FIGS. 2 to 4, the development unit 13 includes the developing roller 13*a* (as developing agent carrier), the transport screws 13*b*1 to 13*b*3 (as auger screw), and the doctor blade 13*c*, for example.

The developing roller 13*a* includes a magnet roll 13*a*1 and a developing sleeve 13*a*2, for example. The magnet roll 13*a*1, fixed at a given position and encased in the developing sleeve 13*a*2, generates a magnetic field around the developing sleeve 13*a*2 so that chains of the developing agent G can be formed on the developing sleeve 13*a*2. The developing sleeve 13*a*2 can be rotated in a clockwise direction by the development unit driving motor 92. The developing sleeve 13*a*2 is formed of non-magnetic material, such as aluminum, brass, stainless steel, and conductive resin, and shaped in a cylindrical tube as illustrated in FIG. 3. Chains of the carrier C in the developing agent G can be formed along the magnetic force line formed on the developing sleeve 13*a*2 (or normal line direction of the magnet roll 13*a*1). The charged toner T is attracted to such chains of the carrier C to form magnetic brushes on the developing sleeve 13*a*2. The magnetic brushes are transported to a rotation direction of the developing sleeve 13*a*2 (in a clockwise direction in FIG. 4) when the developing sleeve 13*a*2 rotates.

The doctor blade 13*c* is disposed at an upstream side of development area to regulate an amount of the developing agent G on the developing roller 13*a* at a preferable level.

The transport screws 13*b*1 to 13*b*3 circulate the developing agent G in the development unit 13 while agitating and mixing the developing agent G. The first transport screw 13*b*1, facing the developing roller 13*a*, transports the developing agent G in a horizontal direction as indicated by a dashed arrow line of FIG. 3(A), and supplies the developing agent G to the developing roller 13*a* as indicated by a white arrow of FIG. 3(A).

The second transport screw 13*b*2 is disposed under the first transport screw 13*b*1 while facing the developing roller 13*a*. The second transport screw 13*b*2 recovers and transports the developing agent G, separated or released from the developing roller 13*a*, in a horizontal direction as indicated by a dashed arrow line of FIG. 3(B). After a developing process, the developing agent G is separated or released from the developing roller 13*a* at its agent releasing pole in a white arrow direction of FIG. 3(B).

The third transport screw 13*b*3 is disposed next to the second transport screw 13*b*2 and under the first transport screw 13*b*1 with some angle as illustrated in FIG. 4. The third transport screw 13*b*3 receives the developing agent G from the downstream side of the second transport screw 13*b*2, and then transports the developing agent G to the upstream side of the first transport screw 13*b*1 as illustrated by a dashed arrow line in FIG. 3(B). The third transport screw 13*b*3 also receives the developing agent G from the downstream side of the first transport screw 13*b*1 via a first interconnection 13*f*, and then transports the developing agent G to the upstream side of the first transport screw 13*b*1 as illustrated by the dashed arrow line in FIG. 3(B). The rotation axis of each of the transport screws 13*b*1 to 13*b*3 are disposed in a substantially parallel and horizontal direction with respect to the developing roller 13*a* and the photoconductor drum 11. Further, the developing roller 13*a* and the transport screws 13*b*1 to 13*b*3 can be rotated by the development unit driving motor 92 (used as the second driving unit) with gears or the like.

The transport route of the first transport screw 13*b*1, the transport route of the second transport screw 13*b*2, and the transport route of the third transport screw 13*b*3 are separated from each other by walls. As illustrated in FIG. 3(B), the downstream side of the transport route of the second transport screw 13*b*2 is communicated to the upstream side of the transport route of the third transport screw 13*b*3 via a second interconnection 13*g*. Further, as illustrated in FIGS. 3(A) and 3(B), the downstream side of the transport route of the first transport screw 13*b*1 is communicated to the upstream side of the transport route of the third transport screw 13*b*3 via the first interconnection 13*f*. Further, as illustrated in FIGS. 3(A), 3(B), and 4, the downstream side of the transport route of the third transport screw 13*b*3 is communicated to the upstream side of the transport route of the first transport screw 13*b*1 via a third interconnection 13*h*. As illustrated in FIG. 4, the developing agent G accumulated around the third interconnection 13*h* in the transport route of the third transport screw 13*b*3 is transported to the upstream side of the transport route of the first transport screw 13*b*1 via the third interconnection 13*h*.

With such configuration, the developing agent G can be circulated in the development unit 13 by the transport screws 13*b*1 to 13*b*3. Specifically, when the development unit driving motor 92 drives the development unit 13, the developing roller 13*a* and the transport screws 13*b*1 to 13*b*3 are rotated, by which the developing agent G stored in the development unit 13 moves in a direction of dashed arrow line shown in FIG. 3. In such configuration, a supply route (i.e., the transport route of the first transport screw 13*b*1) of the developing agent G to the developing roller 13*a* is separated from a recovery route (i.e., the transport route of the second transport screw 13*b*2) of the developing agent G, separated or released from the developing roller 13*a*. Such separation of supply route and recovery route may contribute for suppressing a concentration variation of toner images formed on the photoconductor drum 11.

The magnetic sensor 86 is disposed in the transport route of the third transport screw 13*b*3 to detect toner concentration of the developing agent G circulating in the development unit 13. Based on toner concentration information detected by the magnetic sensor 86 or image concentration information detected by the optical sensor 40, new developing agent G is refilled from the developing agent container 28 to the development unit 13 via the refilling route, such as the supply tube 29 and the refill port 13*e*.

As illustrated in FIGS. 2 and 3, the transport route of the first transport screw 13*b*1 has an ejection port 13*d* to eject some of the developing agent G from the development unit 13 to the agent recovery vessel 70. Specifically, when the developing agent G is supplied from the developing agent container 28, an amount of developing agent in the development unit 13 increases. In such a case, a top level of the developing agent G transported in the development unit 13 may become higher than a height of the ejection port 13*d*, and then excess amount of the developing agent G is ejected from the ejection port 13*d* to the agent recovery vessel 70 via an ejection route using gravity. As such, because the carrier C degraded by mother resin material and external additives of the toner T can be automatically ejected from the development unit 13, image quality degradation can be prevented over time. In an exemplary embodiment, the refill port 13*e* and the ejection port 13*d* is disposed in the transport route of the first transport screw 13*b*1. However, the refill port 13*e* and the ejection port 13*d* can be disposed other portion.

Figure 5:
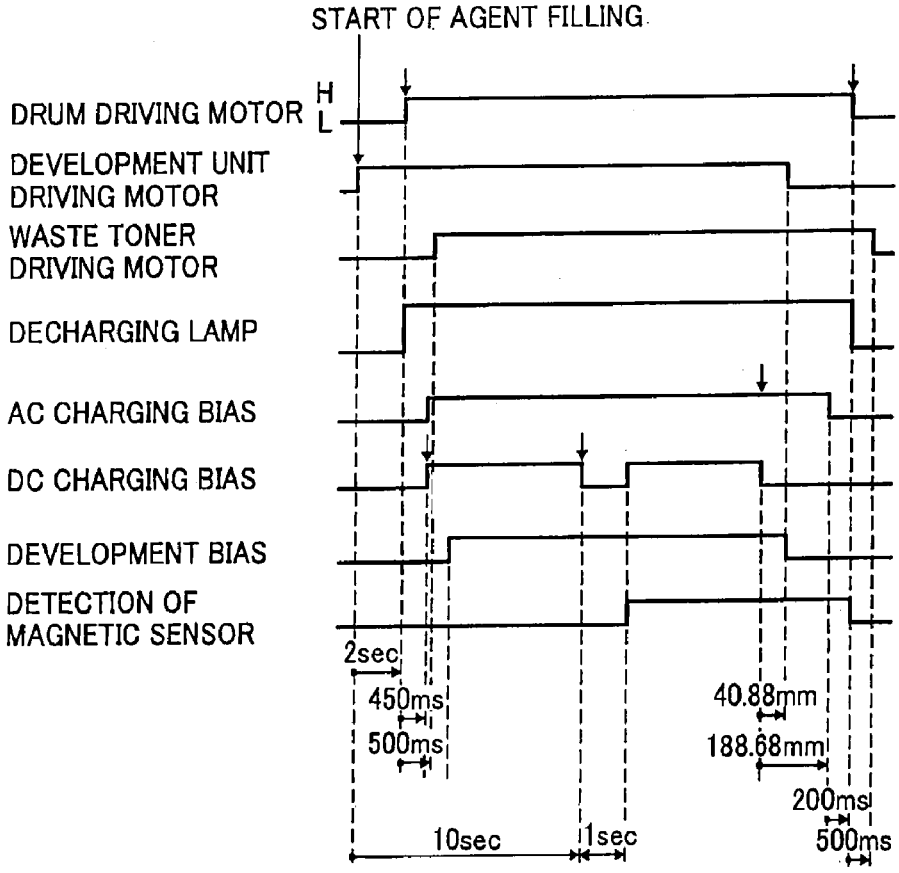
FIG. 5 shows a timing chart for controlling a timing for refilling developing agent.

A description is now given to a control process when refilling a developing agent in an exemplary embodiment. FIG. 5 illustrates a timing chart for the control process when refilling the developing agent.

In an exemplary embodiment, an image forming apparatus is shipped from a factory without filling a developing agent in the development unit 13, which means that the development unit 13 is in agent-empty condition, to prevent scattering of the developing agent during transportation. Such image forming apparatus is transported by road, sea, and air, kept at a delivery agent, and then delivered to a user location, for example. When the image forming apparatus is installed at a user location, an initial developing agent is filled in the empty development unit 13 before initializing settings and checking operations of the image forming apparatus.

In an exemplary embodiment, the developing agent is filled or refilled to the development unit 13 automatically, not manually. A description is now given to the filling or refilling operation of the developing agent.

The image forming apparatus 1 having the agent-empty conditioned development unit 13 is set with the developing agent container 28 having an initial developing agent. A volume size of the developing agent container 28 can be set to any volume. The developing agent container 28 is set to the image forming apparatus 1 after removing a cap or seal of the container, which seals an opening of the container. The developing agent is filled or refilled by activating the development unit 13 and using the refill port 13*e* and the supply tube 29. In an exemplary embodiment, the developing agent can be refilled into the development unit 13 by activating the development unit driving motor 92 (second driving unit), which is also used when conducting a developing process.

Specifically, when a service person (or user) operates a button of an operation unit of the image forming apparatus 1, the controller 87 opens the shutter device 80 and activates the development unit driving motor 92 to activate the developing agent filling operation.

Then, the developing agent in the developing agent container 28 is transported to the development unit 13 via the refilling route, and the developing roller 13*a* and the transport screws 13*b*1 to 13*b*3 rotates to circulate the developing agent in the development unit 13, by which an amount or volume of developing agent in the development unit 13 increases gradually. In an exemplary embodiment, the volume of developing agent stored in the developing agent container 28 may be set to 500 to 600 grams, for example.

In an exemplary embodiment, when the new developing agent is refilled to the agent-empty development unit 13, the development unit driving motor 92 (second driving unit) is activated to start a driving of the development unit 13 at first, and then the drum driving motor 91 (first driving unit) is activated to start a driving of the photoconductor drum 11 after the developing agent filling is started.

As illustrated in FIG. 5, when the developing agent filling operation is started, the drum driving motor 91 is not activated (i.e., the photoconductor drum 11 is not rotated) but only the development unit driving motor 92 is activated at first (i.e., only the development unit 13 is driven at first). After activating the development unit driving motor 92 for a given time duration, the drum driving motor 91 is then activated to start a rotation of the photoconductor drum 11 at a given timing, which is detected by a timer 85. In an exemplary embodiment, a rotation of the photoconductor drum 1 is started after two seconds elapse from the activation of the development unit driving motor 92, for example.

As such, the photoconductor drum 11 is not started to rotate at the same timing of starting the developing agent filling operation, but is started to rotate after some time elapses from the start of the developing agent filling operation. Because the photoconductor drum 11 is started to rotate after starting the developing agent filling operation, toner can be supplied to the leading edge (contact portion) of the cleaning blade 15 within a short period of time after starting a rotation of the photoconductor drum 11. Accordingly, curling of the cleaning blade 15*a* can be prevented because a load applied to the cleaning blade 15*a* contacting the photoconductor drum 11 can be reduced with an effect of the aforementioned toner supply.

On one hand, if the photoconductor drum 11 is driven for a long time without toner supply to the leading edge (contact portion) of the cleaning blade 15, the cleaning blade 15*a* may receive a greater stress, by which curling of the cleaning blade 15*a* may occur.

Further, in an exemplary embodiment, the development unit driving motor 92 is activated to start a driving of the development unit 13 to fill the developing agent in the development unit 13, and just before the developing agent is carried on the developing roller 13*a*, the drum driving motor 91 is activated to start a driving of the photoconductor drum 11.

In other words, when the developing agent filling operation is started, the developing agent is gradually supplied across the development unit 13 evenly and sufficiently, and just before the developing agent is supplied onto the developing roller 13*a*, the photoconductor drum 11 is started to rotate.

Accordingly, when the developing agent is started to be carried on the developing roller 13*a*, the photoconductor drum 11 is already rotated (i.e., not at a rotation stop condition). If the photoconductor drum 11 is not rotated when the developing agent is carried on the developing roller 13*a*, such developing agent may be concentrated at one portion of the surface of the photoconductor drum 11, and may cause scratches or blemishes on the surface of photoconductor drum 11 by abrasion. In an exemplary embodiment, the photoconductor drum 11 is already rotated before the developing agent is carried on the developing roller 13*a*, by which such scratches or blemishes on the photoconductor drum 11 can be prevented.

Because toner can be immediately supplied to the photoconductor drum 11, which starts its rotation, toner can be immediately supplied to the leading edge (contact portion) of the cleaning blade 15*a*, by which curling of the cleaning blade 15*a* can be prevented.

The aforementioned given time (e.g., 2 seconds) detected by the timer 85 is a time between a start timing of the developing agent filling operation and a start timing of supplying the developing agent to the developing roller 13*a*, which is determined based on experiment and simulation conducted for a development process of an apparatus.

In an exemplary embodiment, when the timer 85 detects that the aforementioned given timing elapses after starting the developing agent filling operation, the development unit driving motor 92 is activated to start to rotate the photoconductor drum 11.

Figure 6:
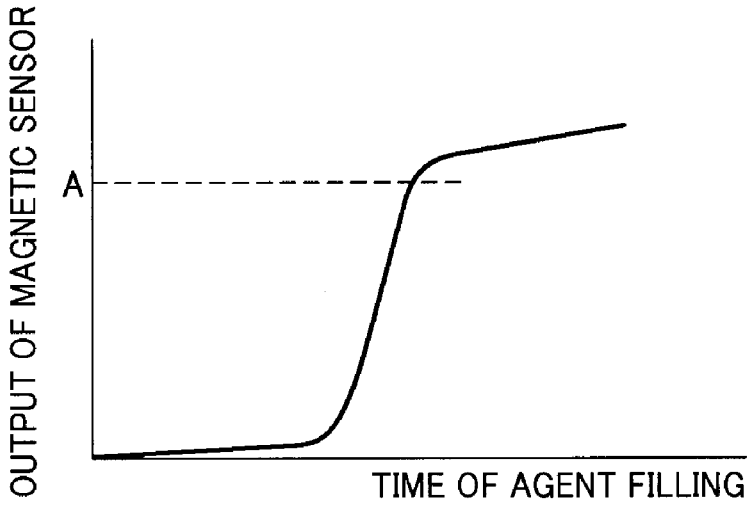
FIG. 6 is a graph showing a relationship of developing agent refilling time and an output of magnetic sensor.

Alternatively, the development unit driving motor 92 is activated to start to rotate the photoconductor drum 11 when the magnetic sensor 86 (toner concentration sensor) detects a given value after starting the developing agent filling operation. Specifically, as shown in FIG. 6, when the developing agent filling operation is started for the agent-empty conditioned development unit 13, the development unit 13 is gradually filled with the developing agent. When the developing agent is evenly and sufficiently supplied across the development unit 13, the developing agent is evenly and sufficiently supplied around the magnetic sensor 86, by which a sensor output increases. Accordingly, when the magnetic sensor 86 outputs a given value A, which is a sufficiently high value, it is determined that the developing agent is started to carry on the developing roller 13*a*, and then the photoconductor drum 11 is started to rotate. A similar effect, such as the curling prevention, according to an exemplary embodiment, can be obtained for such configuration. To reliably control such process using the sensor output, the magnetic sensor 86 may be preferably disposed at the upstream side of the transport route of the first transport screw 13*b*1, for example.

Alternatively, a torque detector 84 is disposed in the development unit 13 as shown in FIG. 2 to detect a drive torque of the development unit 13, and the torque detector 84 can be used to set a starting time of the photoconductor drum 11.

Figure 7:
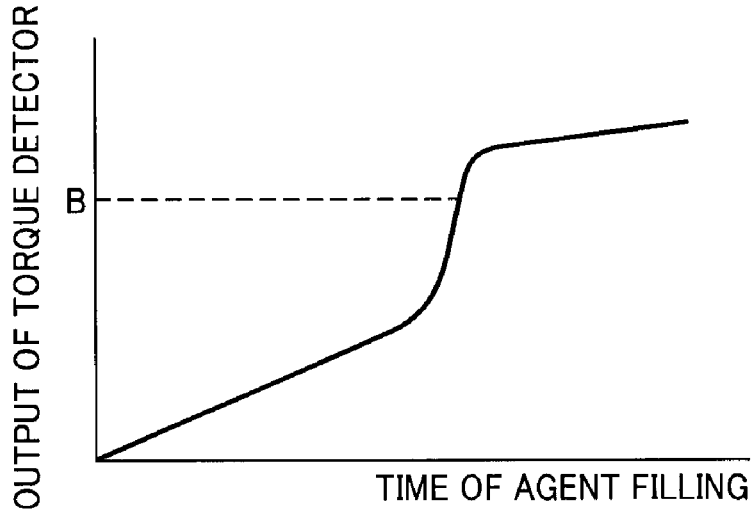
FIG. 7 is a graph showing a relationship of developing agent refilling time and an output of torque detector.

Specifically, when the torque detector 84 detects a given value after starting the developing agent filling operation, the photoconductor drum 11 can be started to rotate. More specifically, when the developing agent filling operation is started for the agent-empty conditioned development unit 13, the development unit 13 is gradually filled with the developing agent. When the developing agent is evenly and sufficiently supplied across the development unit 13, a working load to the developing roller 13*a* and the transport screws 13*b*1 to 13*b*3 increases, by which a drive torque of the development unit 13 increases as shown in FIG. 7. Accordingly, when the torque detector 84 outputs a given value B, which is a sufficiently high value, it is determined that the developing agent is started to carry on the developing roller 13*a*, and then the photoconductor drum 11 is started to rotate. A similar effect, such as the curling prevention according to an exemplary embodiment, can be obtained for such configuration. The torque detector 84 may detect torque value converted from current value supplied to the development unit driving motor 92.

In an exemplary embodiment, when the developing agent is not carried on the developing roller 13*a* at a given time later (e.g., 4 seconds later) after starting the developing agent filling operation, it is determined abnormal condition may occur to the developing agent filling operation. If such abnormal condition is detected, the development unit driving motor 92 and the drum driving motor 91 may be de-activated or stopped, and a display unit of the image forming apparatus 1 may display abnormal condition status for the developing agent filling operation.

With such configuration, a drawback that the photoconductor drum 11 is driven for a long time without toner supply to the leading edge of the cleaning blade 15 can be prevented even if the developing agent filling operation is not conducted in a normal manner after starting the developing agent filling operation. Such abnormal condition may occur when the developing agent container 28 is set to an image forming apparatus without removing the cap from the opening of the developing agent container 28.

As such, by detecting abnormal condition of the developing agent filling operation, drawbacks caused by such abnormal condition can be prevented.

Such abnormal condition detection and the associated control may be conducted when the magnetic sensor 86 cannot detect the given value A. Specifically, when the magnetic sensor 86 does not detect the given value A even the aforementioned given time elapses after starting the developing agent filling operation, the development unit driving motor 92 and the drum driving motor 91 are de-activated or stopped. Similarly, when the torque detector 84 does not detect the given value B even the aforementioned given time elapses after starting the developing agent filling operation, the development unit driving motor 92 and the drum driving motor 91 are de-activated or stopped. Similarly, when the optical sensor 40 (image concentration detector) does not detect a given value for toner image (or patch pattern) formed on the photoconductor drum 11 after starting the developing agent filling operation and the driving of the photoconductor drum 11, it is determined that abnormal condition may occur to the developing agent filling operation, and then the development unit driving motor 92 and the drum driving motor 91 are de-activated or stopped. If the optical sensor 40 does not detect a given value for toner image, a patch pattern is not correctly formed on the photoconductor drum 11 (or image concentration of patch pattern is low), for example. As such, by detecting abnormal condition of the developing agent filling operation, drawbacks caused by such abnormal condition can be prevented.

In an exemplary embodiment, a toner image is formed on the photoconductor drum 11 at a given timing between a time duration after starting the driving of photoconductor drum 11 and before completing the developing agent filling operation for the development unit 13, wherein such time duration is about 30 seconds, for example. Specifically, after the developing agent is carried on the developing roller 13*a* and starting the driving of photoconductor drum 11, a stripe patterned toner image is formed on an image forming area of the photoconductor drum 11 at a given timing.

Specifically, as illustrated in FIG. 5, at 10 seconds later after starting the developing agent filling operation, an application of DC (direct current) charging bias voltage is OFF for about 1 second to form a stripe patterned toner image on the photoconductor drum 11. Because such stripe patterned toner image comes to the cleaning blade 15*a*, the entire leading edge of the cleaning blade 15*a* is effectively supplied with toner, by which the curling of the cleaning blade 15*a* can be prevented because the leading edge is contacted with toner.

In the above described exemplary embodiment, the development unit 13 is automatically refilled with the developing agent from the developing agent container 28, in which the photoconductor drum 11 is started to rotate when a given time elapses after starting the driving of the development unit 13 for the developing agent filling operation. Accordingly, a drawback that the photoconductor drum 11 is driven for a long time without toner supply to the leading edge of the cleaning blade 15 can be prevented. Accordingly, curling of the cleaning blade 15*a* can be prevented while filling the developing agent to the development unit 13 by using relatively simpler configuration and operation for the developing agent filling operation.

In an exemplary embodiment, a pre-mix development method using pre-mixed toner composed of toner and carrier is employed. In such configuration, the developing agent can be refilled to and ejected from the development unit 13 automatically. Specifically, when a developing process consumes toner, new pre-mixed toner is refilled to the development unit 13. Because the pre-mixed toner also includes carrier, a replacement of developing agent in the development unit 13 can be gradually conducted automatically. Accordingly, a manual replacement operation (e.g., replacement by service person) of developing agent may not be required for such pre-mix development method once the development unit 13 and a pre-mixed toner container are set in an image forming apparatus at an installation timing (or product delivery timing).

However, if a developing agent including only toner is used for a developing method, a manual replacement operation by service person may be required for the developing unit. Specifically, in such developing method, when a developing process consumes toner, new toner is refilled to the development unit but new carrier is not supplied. Accordingly, carrier is not replaced in such developing method, by which manual replacement operation is required when the carrier becomes its lifetime. Therefore, when developing agent is degraded, such developing agent is removed from the development unit, and then new developing agent is refilled to the development unit using the above-mentioned agent refilling process. In such a case, a similar effect, such as the curling prevention, according to an exemplary embodiment can be obtained. Further, when removing the developing agent from the development unit, such removing operation is preferably conducted automatically. Specifically, the developing agent may be ejected from an opening, disposed at a bottom of a transport route of the development unit while driving the development unit. The opening is closed during a normal operation. Such developing agent ejection can be preferably controlled using the developing agent filling control of an exemplary embodiment.

Further, in an exemplary embodiment, the three transport screws 13*b*1 to 13*b*3 are disposed in the development unit 13 as transport member. However, a number of transport screws can be changed to two, or four or more for the development unit 13. Further, in an exemplary embodiment, the third transport screw 13*b*3 is disposed in a horizontal direction. However, the third transport screw 13*b*3 can be disposed in a slanted direction with respect to a horizontal direction.

Further, in an exemplary embodiment, the developing agent container 28 supplies the developing agent G (toner T and carrier C) to the development unit 13. However, only the carrier C can be supplied from a developing agent container (carrier container) to the development unit 13. In such a case, toner container storing only toner is disposed separately from the developing agent container, and toner is refilled to the development unit 13 from the toner container based on a detection result of the magnetic sensor 86 or the optical sensor 40, in which similar effect according to an exemplary embodiment can be obtained.

Further, in an exemplary embodiment, the development unit 13 is detachably mountable to the image forming apparatus 1. However, a process cartridge integrating several units can be used in the image forming apparatus 1. For example, such process cartridge may at least include the photoconductor 11 and any one of the charging device 12, the development unit 13, the cleaning unit 15, and is detachably mountable to the image forming apparatus 1.

As above described, when a development unit is refilled with a developing agent automatically, the development unit is started to be driven at first, and then an image carrying member is started to rotate after such refilling of developing agent to the development unit is started. Accordingly, the image carrying member may not be rotated for a long period time without toner supply to a leading edge of a cleaning blade. Therefore, the development unit can be refilled with the developing agent with a simpler configuration and operation without causing drawbacks, such as curling of the cleaning blade, when refilling the developing agent for an image forming apparatus.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

The invention claimed is:

1. An image forming apparatus, comprising:

an image carrying member configured to form a latent image thereon;

a development unit configured to develop the latent image formed on the image carrying member;

a first driving unit configured to drive the image carrying member;

a second driving unit configured to drive the development unit; and a cleaning blade, contactable against the image carrying member, configured to remove materials including toner remaining on the image carrying member, wherein, when the development unit having an agent-empty condition is filled with a developing agent, the second driving unit is activated to start a driving of the development unit, and the first driving unit is activated to start a driving of the image carrying member after starting a developing agent filling operation to the development unit and before the developing agent is delivered to the image carrying member.

2. The image forming apparatus according to claim 1, wherein the development unit includes a developing agent carrier disposed facing the image carrying member and configured to carry the developing agent, and the first driving unit is activated to start a driving of the image carrying member after starting the developing agent filling operation and just before the developing agent carrier delivers the developing agent.

3. The image forming apparatus according to claim 1, further comprising a toner concentration sensor configured to detect toner concentration in the developing agent used in the development unit, wherein the first driving unit is activated to start a driving of the image carrying member when the toner concentration sensor detects a given value after starting the developing agent filling operation.

4. The image forming apparatus according to claim 1, further comprising a torque detector configured to detect a drive torque of the development unit, wherein the first driving unit is activated to start a driving of the image carrying member when the torque detector detects a given value after starting the developing agent filling operation.

5. The image forming apparatus according to claim 1, further comprising a timer configured to detect an operating time of the second driving unit, wherein the first driving unit is activated to start a driving of the image carrying member when the timer detects that a given time elapses after starting the developing agent filling operation.

6. The image forming apparatus according to claim 1, wherein the development unit includes a developing agent carrier disposed facing the image carrying member and configured to carry the developing agent, and when the developing agent is filled to the development unit empty of agent, the second driving unit is activated to start a driving of the development unit, the first driving unit is activated to start a driving of the image carrying member after starting the developing agent filling operation, and the first driving unit and the second driving unit are de-activated when the developing agent is not delivered on the developing agent carrier when a given time elapses after starting the developing agent filling operation.

7. The image forming apparatus according to claim 6, further comprising a toner concentration sensor configured to detect toner concentration in the developing agent used in the development unit, wherein the first driving unit and the second driving unit are de-activated when the toner concentration sensor fails to detect a given value when a given time elapses after starting the developing agent filling operation.

8. The image forming apparatus according to claim 6, further comprising a torque detector configured to detect a drive torque of the development unit, wherein the first driving unit and the second driving unit are de-activated when the torque detector fails to detect a given value when a given time elapses after starting the developing agent filling operation.

9. The image forming apparatus according to claim 6, further comprising an image concentration detector configured to detect a toner image formed on the image carrying member, wherein the first driving unit and the second driving unit are de-activated when the image concentration detector fails to detect a given concentration value for the toner image formed on the image carrying member after starting the developing agent filling operation.

10. The image forming apparatus according to claim 9, wherein the toner image is formed between a start of driving the image carrying member and completion of the developing agent filling operation.

11. The image forming apparatus according to claim 10, wherein the toner image is formed on an image forming area of the image carrying member as a striped pattern at a given timing.

12. The image forming apparatus according to claim 1, further comprising a refilling route and a developing agent container for refilling the development unit with new developing agent from the developing agent container via the refilling route when the developing agent is consumed by a developing process.

13. The image forming apparatus according to claim 1, wherein the developing agent is a two-component developing agent composed substantially of toner and carrier.

14. The image forming apparatus according to claim 1, wherein the first driving unit is activated to start a driving of the image carrying member two seconds after starting the developing agent filling operation to the development unit.

15. A method of filling a development unit empty of agent for use in an image forming apparatus having an image carrying member, comprising:

1) activating the development unit to fill the development unit with a developing agent; and 2) activating the image carrying member to rotate the image carrying member after activating the developing unit for a given time and before the developing agent is delivered to the image carrying member.

16. The method according to claim 15, wherein the development unit includes a developing agent carrier disposed facing the image carrying member and configured to carry the developing agent, and the image carrying member is activated just before the developing agent carrier delivers the developing agent.

17. The method according to claim 16, further comprising de-activating the image carrying member and the development unit when it is determined that the developing agent is not delivered on the developing agent carrier when a given time elapses after activating the development unit and the image carrying member.

18. The method according to claim 15, wherein the activating the image carrying member to rotate the image carrying member occurs two seconds after activating the developing unit.

* * * * *